US008959839B1

(12) United States Patent
Hamlin, III

(10) Patent No.: US 8,959,839 B1
(45) Date of Patent: Feb. 24, 2015

(54) FOAM-FILLED, MEMBRANE-COVERED BARRIER FOR RAISING FLAT ROOF LOW AREAS

(71) Applicant: Henry Lee Hamlin, III, Forsyth, GA (US)

(72) Inventor: Henry Lee Hamlin, III, Forsyth, GA (US)

( * ) Notice: Subject to any disclaimer, the term of this patent is extended or adjusted under 35 U.S.C. 154(b) by 0 days.

(21) Appl. No.: 13/987,485

(22) Filed: Jul. 30, 2013

(51) Int. Cl.
*E04B 1/34* (2006.01)
*E04D 11/02* (2006.01)

(52) U.S. Cl.
CPC ..... *E04D 11/02* (2013.01)
USPC ..... 52/2.22; 52/2.24; 52/309.9; 52/309.12; 52/411; 52/514.5

(58) Field of Classification Search
CPC ..... E04G 23/0203; E04G 23/02; B29C 44/18; B29C 73/10; B29C 70/443; E04B 1/66; E04D 3/352; E04D 5/142; E04D 13/1407; E04D 13/1681; E04D 13/0481
USPC ..... 52/309.1, 309.4, 309.9, 309.12, 411, 52/514, 514.5, 2.22, 2.11, 2.17, 2.24
See application file for complete search history.

(56) References Cited

U.S. PATENT DOCUMENTS 3,958,373 A * 5/1976 Stewart et al. ..... 52/58
6,006,482 A * 12/1999 Kelly ..... 52/409
2012/0073693 A1* 3/2012 Collier et al. ..... 138/103

* cited by examiner

*Primary Examiner* — William Gilbert
*Assistant Examiner* — Gisele Ford
(74) *Attorney, Agent, or Firm* — Harry I. Leon; Vivian L. Steadman

(57) ABSTRACT

A low cost method for constructing barriers to eliminate a flat or low pitch roof's low spots. Puddles, if allowed to stand there, shorten the roof's life and can do structural damage to the roof deck. Each barrier includes a flexible membrane initially sized and shaped and then positioned to cover at least one low spot and substantially overlap the latter's edges. So positioned, the membrane is heat welded or otherwise joined to form a continuous watertight seal, along its outer periphery, between the membrane and an existing roof deck covering and, when the low spot is next to a parapet, the existing parapet covering as well. Filled with a solidified plastic foam sandwiched between the membrane and the existing covering(s), such barriers, once they have been mechanically fastened to the roof deck and, if necessary, to the parapet, permanently direct storm water away from each of the roof's barrier-covered low spots.

7 Claims, 3 Drawing Sheets

FOAM-FILLED, MEMBRANE-COVERED BARRIER FOR RAISING FLAT ROOF LOW AREAS

CROSS REFERENCE TO RELATED APPLICATION

This application is a continuation-in-part application of pending U.S. patent application Ser. No. 13/385,400, filed Feb. 17, 2012.

FIELD OF THE INVENTION

The present invention relates to a method and device for directing storm water once it has been captured on a flat or low-pitch roof toward the roof's drains and scuppers and, more particularly, to such a device which is membrane-covered and forms a water repelling barrier for elevating a recessed area of the roof.

BACKGROUND OF THE INVENTION

Drainage of flat and low-pitch industrial roofs is complicated by the fact that they typically have low areas where rain water tends to pool. Pooled water, subject to frequent freeze/thaw cycles, not only stresses the roofing materials and the roof deck but also forms an environment where mosquitoes and other insects can breed and which nurtures the growth of mold and fungus.

In a typical industrial flat roof, roof drains are arrayed on 10 to 30 foot centers. Any low areas located between these roof drains need to be filled in to allow for proper drainage.

Moreover, in the case of a flat or low-pitch roof in which the roof abuts a parapet wall along at least a portion of the roof's outer perimeter, low areas can often be found next to the parapet wall, interspersed between individual parapet-penetrating openings at the roof/parapet wall interface. Fluidly connected via a scupper to a roof downspout as a rule, each parapet-penetrating opening is generally widely spaced apart from its respective nearest neighbors at the parapet wall.

In order to fill in these low areas and direct storm water toward the roof drains and/or the scuppers, one can utilize tapered roof insulation. Unfortunately, installing tapered roof insulation is a very costly, time-consuming process, entails extensive application of glues formulated from hazardous materials, and generates a tremendous amount of waste.

A less time and material-consuming construction process, as taught by Hamlin in U.S. patent application Ser. No. 13/385,400, is based on assembling an inflatable membrane. Each such membrane is equipped, prior to its being assembled on site, with an air valve permanently mounted on the membrane's outer surface. Not only must the inflatable membrane be sized and shaped to cover one of the roof's low spots (or a set of more or less contiguous low spots) and substantially overlap the latter's edges but also the membrane must be heat welded or otherwise joined to the existing roof covering or, alternately, a second membrane to form an air-tight pocket in combination with the roof covering or the second membrane. Once properly constructed and then inflated, with the use of the air valve, the inflatable membrane, buoyed by this air pocket, protrudes upwardly, effectively elevating the covered low spot(s) and preventing water from puddling there during a rainstorm. Post construction, however, one must constantly maintain the air pocket in an inflated state or risk an unexpected collapses of the inflatable membrane onto the roof.

SUMMARY OF THE INVENTION

The object of the present invention is to provide a permanently elevated, membrane-covered barrier for directing storm water captured on a flat or low-pitch roof towards the roof's drains and, in the process, reducing or eliminating the formation of puddles of standing water on the roof.

A further object is to provide such a barrier for directing storm water captured on a flat or low-pitch roof in which the roof abuts a parapet wall along at least a portion of the roof's outer perimeter, in such a way that the barrier, when mounted so that it covers low spot(s) next to the parapet wall, diverts water, which would otherwise pool there, into at least one scupper via the parapet-penetrating opening thereto.

A still further object is to provide a low cost method for permanently elevating a flat or low pitch roof's recessed areas, other than those contiguous with its drains, with each recessed area so elevated encompassing the maximum extent to which storm water otherwise pooled in that particular recessed area can spread laterally, in any given direction, across the roof.

A still further object is to provide such a method by which one can easily adjust the drainage patterns as the roof ages and settles.

In accordance with the present invention, there is provided a membrane-covered barrier which includes at least one membrane fabricated from a heat weldable, thermoplastic material, the membrane being adequately sized and shaped to cover at least one of the roof's low spots and substantially overlap its edges; means for joining the membrane so as to form a continuous watertight seal between the membrane and an existing roof deck covering or, alternately, when recessed portion(s) of the roof's low spot (or set of contiguous low spots) are disposed next to a parapet wall, between the membrane and existing roof deck and parapet wall covering(s), the watertight seal being disposed proximate with the membrane's outer periphery; and a spray foam filling which is disposed inwardly of the watertight seal and sandwiched, in the spray foam's solid state, between the membrane and the existing covering for the roof deck or, alternately, the existing covering(s) for the roof deck and parapet wall. In addition, prior to use, the membrane is mechanically fastened, along its outer periphery, to the roof deck and, if necessary, to a part of the parapet wall proximate with the roof's low spot(s). With the membrane so mechanically fastened and the spray foam filling solidified in its place, the membrane-covered barrier protrudes generally upwardly from the roof, thereby permanently obscuring and effectively elevating the low spot(s) which the membrane covers.

For those roofs or, alternately, roofs/parapet walls with existing covering(s) made of a material compatible with the membrane and to which it can be heat welded, only a single membrane, joined by a watertight seal to the existing covering(s), is needed in order to construct a membrane-covered barrier. In each such barrier, the single membrane must define, in combination with the existing covering(s), a watertight pocket which is so dimensioned that once it has been filled to substantially near its full capacity, the membrane-covered barrier protrudes generally upwardly from the surface of the roof.

On the other hand, for those roofs or, alternately, roofs/parapet walls with existing covering(s) to which the membrane cannot be heat welded, either because of the material properties of the existing covering(s) or of the membrane itself, or of both, two further embodiments of the membrane-covered barrier are provided. In the first of these, a double-sided butyl tape or the like is juxtaposed between the membrane and the existing covering(s) by first affixing one of the tape's sticky sides to the latter and, in the case of the roof's existing covering, by so affixing the tape proximate with the outer edges of the roof's recessed area. The membrane is next affixed, along its outer periphery, to the tape's other sticky side. Glues, adhesives, and/or solvents can also be used to achieve a watertight seal at the membrane/existing covering(s) juncture.

Alternately, the membrane-covered barrier comprises at least one pair of membranes, each of which is in the form of a single layer of a heat weldable, thermoplastic material. Properly sized and shaped, the paired membranes can be pre-fabricated for use as a "corner cricket" or the like by joining together their respective outer peripheries so as to form a continuous watertight seal and a pocket, disposed inwardly thereof, for receiving a spray foam filling. In order to accommodate differences in the angular structures which exist at the junctures between roof decks and parapet walls and between roof decks and parapet corners, the shape of the pocket is preferably designed with the use of computer imaging technology. Installation of a pre-fabricated membrane-covered barrier, if it also includes a solidified spray foam filling and is thus completely pre-formed, is then reduced to a single step: mechanically fastening the barrier's outer periphery to the roof deck and, if necessary, to a part of the parapet wall/corner extending upwardly therefrom.

The improved low cost method for permanently elevating a flat or low pitch roof's recessed areas, other than those contiguous with its drains, includes the following steps:

1) Removing any water standing in the roof's recessed area(s);
2) Cutting at least one membrane in the form of a single layer of a heat-weldable, thermoplastic material to a size and shape which allows the installer not only to cover at least one recessed area, with the membrane but also to create, proximate with its outer periphery, a continuous watertight seal between the membrane and the existing roof deck covering or, alternately, between the membrane and the existing roof deck/parapet wall covering(s), whenever the existing covering(s) are made of a heat-weldable material compatible with that of the membrane;
3) Heat welding the membrane to the existing covering(s), the heat welding being carried out in such a way as to create both a continuous watertight seal and a pocket, the watertight seal being formed proximate with the membrane's outer periphery and the pocket, which is defined by the membrane and the existing covering(s), being disposed inwardly of the watertight seal;
4) Mechanically fastening the membrane to the roof deck and, if necessary to the parapet wall;
5) Cutting at least one short, charging slot into the membrane at a site spaced apart from the membrane's outer periphery;
6) Feeding spray foam-generating chemical agents, in their respective liquid states, into the pocket with the use of an elongated, tube-like wand or the like inserted into the charging slot;
7) Determining when to withdraw the wand, and then withdrawing it, so that the spray foam, as it is generated, expands, and solidifies within the pocket, forms a filling of the desired shape and size;
8) Trimming away any excess spray foam which has oozed out of the charging slot; and
9) Affixing a patch over the charging slot by heat sealing or gluing the patch in place.

A modified low cost method is employed in those situations in which a membrane cannot be heat-welded to the existing covering(s). Instead of heat welding the membrane thereto, it is joined to said covering(s) with the use of a double-sided butyl tape or the like.

Alternately, a pair of membranes, each a single layer of a heat weldable, thermoplastic material, can be heat welded together to form a pre-fabricated membrane-covered barrier. Once such a barrier has been mechanically fastened to the roof deck and, if necessary, to the parapet wall, the barrier's pocket is then filled with spray foam in accordance with the steps enumerated hereinabove. These steps can also be reversed in certain applications. The latter approach entails injecting the spray foam-generating chemical agents into the pocket of the membrane-covered barrier before it has been so mechanically fastened. In those situations in which "crickets" are deployed to direct storm water away from a parapet wall and into scuppers via parapet wall-penetrating openings, an installer can realize substantial time savings by using membrane-covered barriers, each with its own pre-formed filling.

DETAILED DESCRIPTION OF THE PREFERRED EMBODIMENTS

Figure 1:
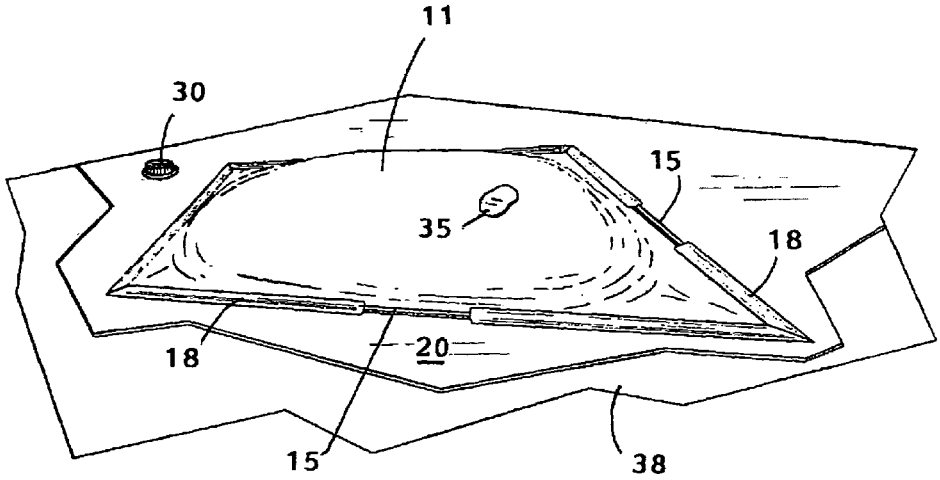
FIG. 1 shows a top perspective view of the foam-filled, membrane-covered barrier according to the present invention, the barrier being shown in position to facilitate draining an interior segment of a flat roof, only fragmentary portions of a protective cover strip for brackets used to fasten the barrier to the roof deck being illustrated.

In the drawings, two basic embodiments of the membrane-covered barrier according to the present invention are illustrated. These embodiments differ from each other in whether they utilize one membrane 11 or two membranes 11, 12 in order to create a pocket 21 or 22, within each individual barrier, in which a spray foam filling 13, in its solid state, is subsequently housed. Regardless of the number of membranes 11, 12, each such membrane is preferably in the form of a single layer of a heat weldable, thermoplastic material.

In those situations in which a roof deck 38, 40 and a parapet wall 41, 42, if also present, have existing covering(s) 20, 24, respectively, each fabricated from a material which is compatible, from a heat welding perspective, with the membranes 11, 12, then only a single membrane 11, which serves as a top layer in the assembled barrier, suffices. Otherwise in order to form the barrier's pocket utilizing heat welding techniques, both of the membranes 11, 12 are required, with the latter membrane forming a lower layer disposed generally contiguous with the existing covering(s).

Figure 2:
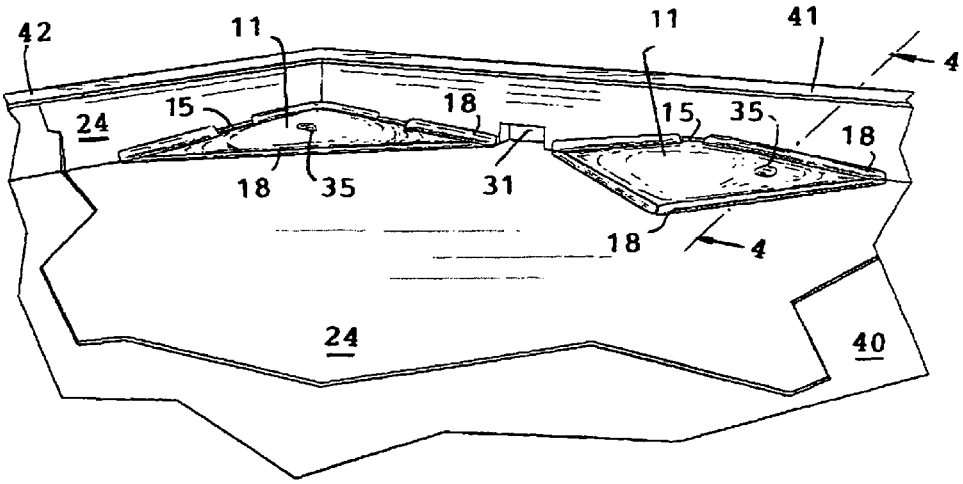
FIG. 2 shows a pair of foam-filled, membrane-covered barriers according to FIG. 1, which are positioned on either side of a scupper-connected opening formed in a parapet wall, each barrier having an exposed membrane with first and second portions mechanically fastened to the roof deck and to the parapet wall, respectively.
Figure 3:
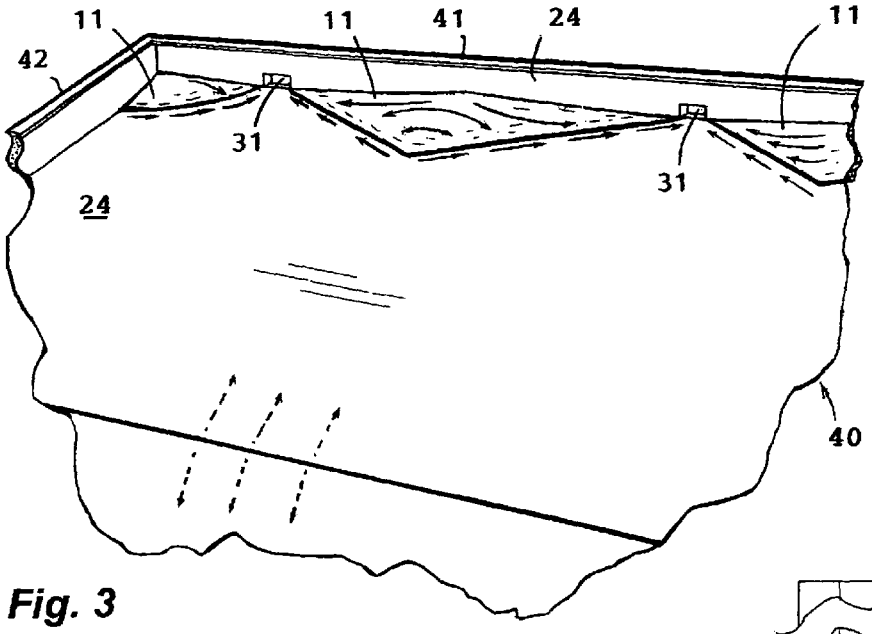
FIG. 3 shows diagrammatically a fragmentary portion of an array of foam-filled, membrane-covered barriers according to FIG. 1, one of which is positioned next to a parapet wall's corner and another between two scupper-connected openings in the parapet wall, with arrows being added thereto to show the direction of downward slopes at various points on or contiguous with the barriers and along the roof's ridgeline.
Figure 4:
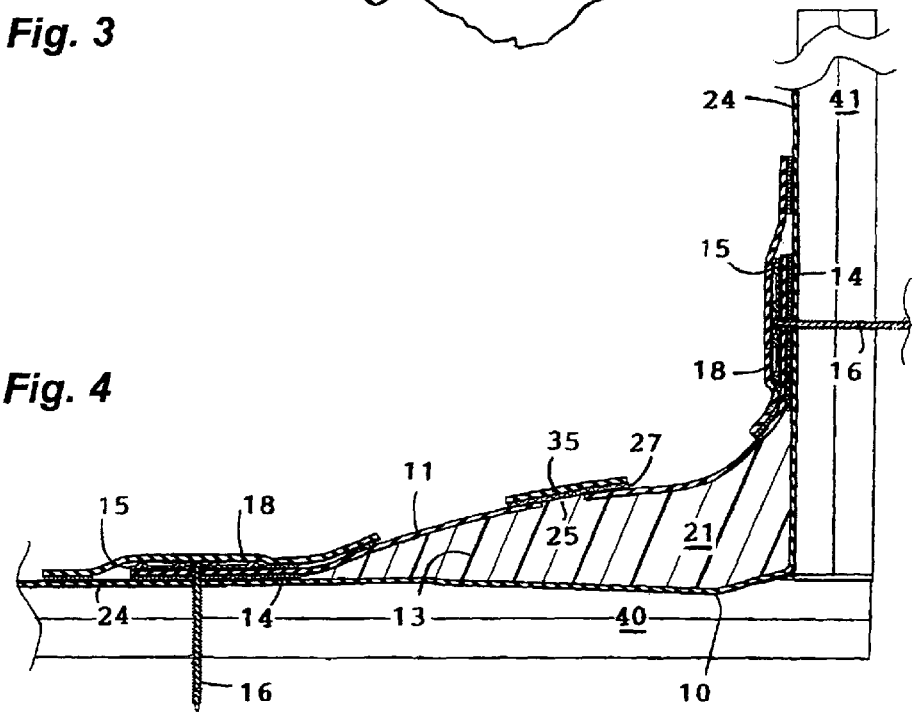
FIG. 4 is a cross-section, taken on line 4-4 of FIG. 2 and on an enlarged scale, of a foam-filled, membrane-covered barrier according to the present invention, the barrier being shown in such a way that it bridges a recessed area disposed next to a longitudinally-extending section of the parapet wall.
Figure 5:
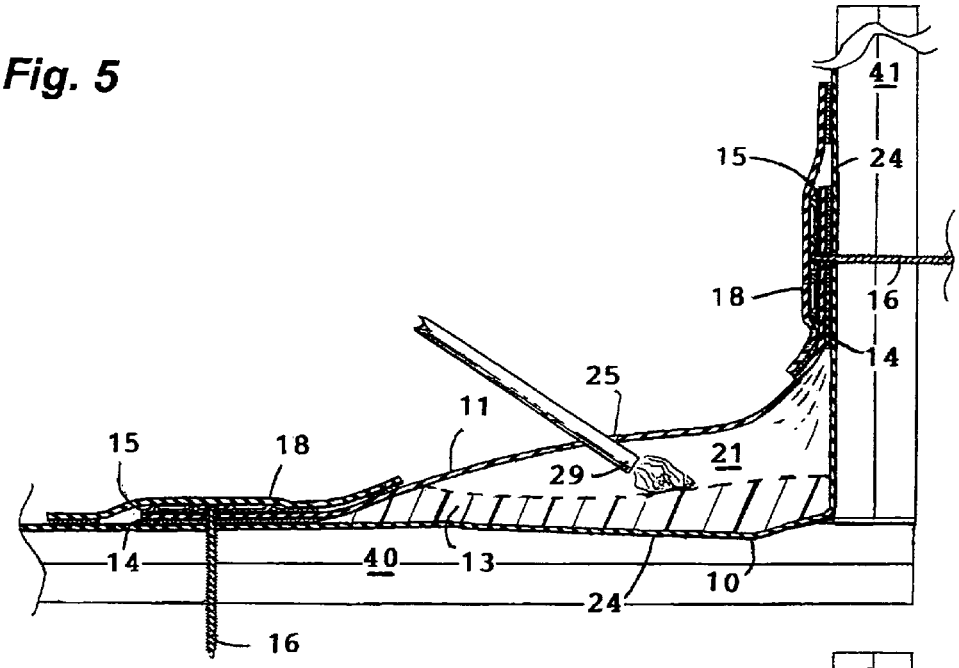
FIG. 5 is a cross-section, also taken on line 4-4 of FIG. 2, of the membrane-covered barrier depicted there but at an intermediate stage during its installation process, the intermediate stage illustrated being one in which spray foam-generating chemical agents are being discharged from the tip of a wand inserted through a charging slot cut in the barrier's exposed membrane, with only a fragmentary portion of the wand being shown.
Figure 6:
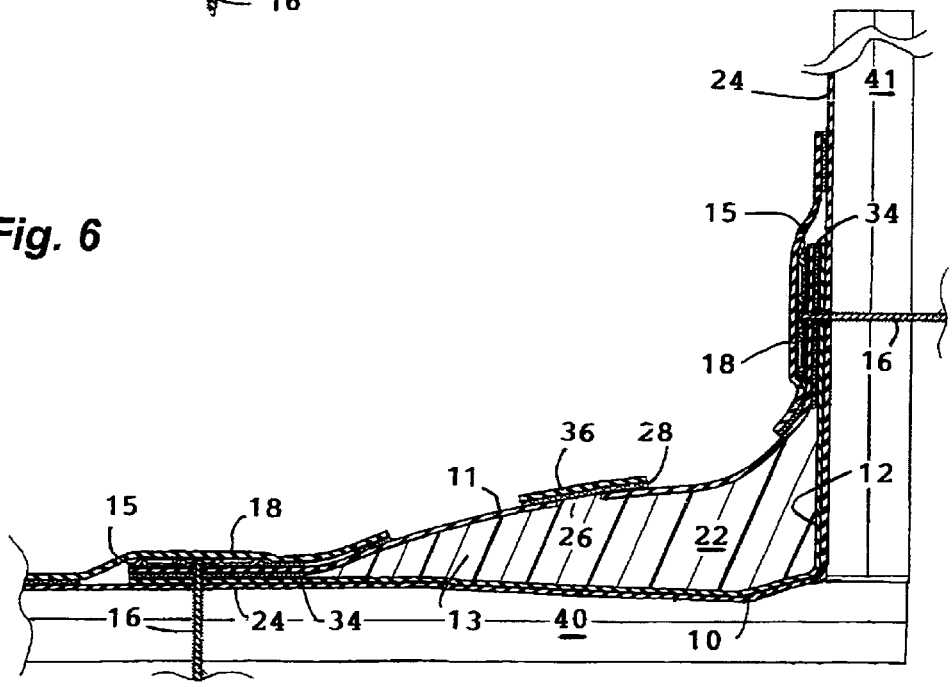
FIG. 6 is a cross-section of an alternate embodiment of the membrane-covered barrier according to the present invention in which the barrier is pre-fabricated and then pre-formed by successively heat welding two membranes together proximate with their respective outer edges and then filling a pocket with spray foam, the pocket being defined by the two membranes and disposed inwardly of said outer edges, the barrier being shown in a position in which it bridges a recessed area located next to a longitudinally-extending section of a parapet wall.

In either basic embodiment, once the membrane-covered barrier has been assembled and mechanically fastened to the roof deck 38, 40 so as to cover at least one recessed area 10 and overlap its edges, the membrane 11 is cut, at points thereon which are spaced apart from its outer periphery, to form at least one charging slot 25, 26 (FIGS. 4-6). Fed into the pocket 21, 22 through the tip 29 of an elongated wand or the like inserted into the charging slot 25, 26, plastic spray foam-generating chemical agents, in their respective liquid states, are then coated onto the pocket's interior surfaces. These chemical agents react quickly to produce a spray foam which, as it expands, builds up beneath the membrane 11 and ultimately solidifies there. With the pocket 21, 22 filled to substantially near its full capacity with solidified spray foam 13, the barrier protrudes upwardly from the roof deck 38, 40 as a whole and redirects storm water captured near the barrier to flow towards at least one of the roof's drains 30 or scupper openings 31 (FIGS. 1-3).

A wide variety of open and closed cell spray foam materials are suitable for use as the filling 13 and are preferably tailored to each specific application of the membrane-covered barrier according to the present invention. A medium density closed cell spray foam insulation product, known as MD-C-200 and available commercially from ICYNENE Inc., for example, has a rigid, not flexible composition which expands 40-fold from its liquid state and is preferred in most applications. Nevertheless, although the MD-C-200s composition rejects bulk water, it should not be used on exterior surfaces which are exposed to and/or in contact with water, according to the manufacturer. As a consequence, a filling 13 made of MD-C-200, a preferred spray foam material, must be protected by a continuous watertight seal 14 between the membrane 11 and existing covering(s) 20, 24 (FIGS. 1-5). Similarly, a continuous watertight seal 34 is required between the two membranes 11, 12 when they are heat welded together proximate with their respective outer edges to form a pocket 22 and it is subsequently filled with MD-C-200 or the like (FIG. 6).

In addition, each charging slot 25, 26 is preferably permanently capped, once any excess plastic spray foam which has oozed out of it has been trimmed away, by a patch 35, 36 (FIGS. 4 and 6). Affixed to the membrane 11, the patch 35, 36 is joined thereto by heat welding techniques or adhesives in such a way as to form a watertight seal 27, 28 which surrounds the slot 25, 26, thereby further protecting the filling 13 from exposure to and/or contact with water.

Alternately, instead of heat welding the two membranes 11, 12 together proximate with their respective outer edges to form a watertight pocket 22, one can affix the membrane 11 to non-heat weldable covering(s) 20, 24 with the use of a double-sided butyl tape (not shown) or the like, as disclosed in my pending U.S. patent application Ser. No. 13/385,400.

Before the installer actually heat welds or otherwise joins the membrane 11 to the existing covering(s) 20, 24 or, alternately to a second membrane 12 on site, it is recommended that he first determine the extent to which water pooled in the recessed area 10 to be "raised" can spread laterally in the form of a possible puddle and note the location of the nearest roof drain 30 or scupper opening 31 situated downhill from this recessed area. It is further recommended that he pump out pooled water, if present, from the recessed area 10 or otherwise dry it and then lay out on the existing roof deck covering 20, 24 a heat weldable, thermoplastic material such as the Carlisle TPO Sure-Weld from which the membrane 11 is to be cut. The material thus laid out should not only substantially overlap the recessed area's outer edges but also be oriented in such a way that when the yet-to-be created pocket 21, 22 is subsequently filled with solidified plastic spray foam 13, the membrane-covered barrier's overall configuration will be one that facilitates movement of storm water towards said nearest roof drain 30 or scupper opening 31.

As illustrated in the drawings, membrane-covered barriers according to the present invention can be configured to fit into a wide variety of complex angular structures including corners where a low pitch roof deck 40 meets intersecting parapet wall sections 41, 42 (FIGS. 2 and 3). This high degree of flexibility in the choice of configuration for membrane-covered barriers allows an installer to array them next to a parapet wall 41, 42 and funnel storm water away from it to nearby scupper-connected, parapet-penetrating opening(s) 31 (FIGS. 2-6).

Specifically, in the case of a membrane-covered barrier, or "cricket", installed between two contiguous scupper opening 31 along a longitudinally-extending reach of a parapet wall 41, the overall shape of the barrier, with its spray foam filling 13 solidified and in place, bisected horizontally, is preferably generally triangular in transverse cross-section. By utilizing such a triangularly-shaped barrier and positioning one of them on either side of a scupper opening 31, one can effectively funnel storm water into it (FIGS. 2 and 3).

Likewise, in the case of a membrane-covered barrier, or "corner cricket", installed at a parapet wall's corner, the overall shape of the barrier, with its solidified filling 13, is preferably one which, bisected horizontally, is generally triangular in transverse cross-section. By utilizing such a barrier on either side of the scupper opening 31 nearest to the parapet wall's corner, one can then funnel storm water away the corner and into the scupper (FIGS. 2 and 3).

Means for mechanically fastening the membrane 11, once it has been heat welded proximate with its outer periphery to either compatible existing covering(s) 20, 24 or to a second membrane 12, or has been joined to the covering(s) with the use of a double-sided butyl tape or with one or more adhesives, glues, solvents, or the like, preferably includes a plurality of elongated, galvanized plates 15, each of which is affixed to either the roof deck 38, 40 or a parapet wall section 41, 42, if present, with the use of screw-like fasteners 16 (FIGS. 1-6). Alternately, a mounting bracket (not shown) can be utilized in combination with generally circular galvanized plates and fasteners 16, as disclosed in my pending U.S. patent application Ser. No. 13/385,400. The plates, whether elongated or circular, and the fasteners 16, as well as the mounting bracket, can, alternately, be made from aluminum or stainless steel.

In addition to its helping hold the membrane-covered barrier in place on the roof, each of the elongated plates 15 and its respective fasteners 16 are employed to press the outer edges of the membrane 11 against the existing covering(s) 20, 24, or alternately, to press the outer edges of conjoined membranes 11, 12 against each other, sandwiching them between the plate and a contiguous covering 20, 24 and thereby maintaining the continuity of watertight seals 14, 34.

A cover strip 18, made of a heat sealable material, is preferably utilized to protect the mechanical fasteners as they hold the membrane-covered barrier in position on either a roof deck 38 or a roof deck 40 in combination with a parapet wall. The strip 18 is preferably affixed along its outer edges to both the membrane 11 and the existing covering(s) 20, 24 so as to form watertight seals with both.

It is claimed:

1. In combination with an existing heat weldable, thermoplastic roof covering affixed to a generally flat or low pitch roof which abuts a parapet, the parapet defining at least one interior corner and a scupper-connected, parapet-penetrating opening spaced apart therefrom, the roof covering extending upwardly onto the parapet and being securely attached to portions thereof which are disposed contiguous with the roof and intersect at said interior corner, a barrier which comprises:

(a) a sheet-like, triangularly-shaped membrane having first, second and third elongated sides which are heat welded along the entire length of each side to the existing covering so as to form first, second and third continuous watertight seals, respectively, the watertight seal thus formed between each side's distal ends being an integral part of a longer continuous watertight seal, likewise formed by heat welding the membrane to the existing covering, which extends in a continuous loop proximate with the membrane's outer periphery;

(b) the first and second elongated sides, which are oriented perpendicularly to each other proximate with the interior corner, extending downwardly therefrom until they reach widely spaced apart points along the parapet/roof joint, one of said widely spaced apart points being located in close proximity to said parapet-penetrating opening and the other being separated therefrom by the span of the membrane's third elongated side;

(c) the membrane and the existing covering defining an enclosure bounded by the longer continuous watertight seal, the membrane defining at least one charging slot which is spaced apart from the longer continuous watertight seal and is connected to the enclosure; and (d) a solidified spray foam filling, formed by feeding spray foam-generating chemical agents, in their respective liquid states, through the charging slot and into the enclosure, the spray foam filling being disposed inwardly of the longer continuous watertight seal; the solidified filling, once the enclosure has been filled to substantially its full capacity with it, having an overall shape which, if the solidified filling were cut straight through horizontally, would be generally triangular in transverse cross-section, with each transverse cross-section so cut being generally larger in size than any such transverse cross-section disposed upwardly of it, thus giving the membrane-covered, solidified filling a facade, disposed inwardly of the interior corner, which slopes downwardly and away from both of the corner's intersecting vertical faces, so that storm water which would otherwise fall onto the roof near the corner and/or flow across the roof towards it is instead intercepted by the facade and funneled along its base directly into the parapet-penetrating opening.

2. The barrier according to claim 1, which further comprises means for mechanically fastening the membrane, proximate with its outer periphery and outwardly of the longer continuous watertight seal, to the roof's deck and the parapet's wall.

3. The barrier according to claim 1, which further comprises a patch which is affixed to the membrane so as to cover the charging slot, the patch being affixed to permanently cover the charging slot after the spray foam-generating chemical agents have been fed through the charging slot and into the enclosure and the spray foam therein has solidified.

4. A barrier adapted to be mounted on a building having a generally flat or low pitch roof with a parapet, the parapet defining at least one interior corner and a scupper-connected, parapet-penetrating opening spaced apart therefrom, which comprises:

(a) a skin which includes upper and lower generally angularly shaped membranes, each of which is fabricated from a single layer of a heat weldable, thermoplastic material;

(b) the upper and lower membranes being affixed to each other along a plurality of heat welded joints, each of said heat welded joints being an integral part of an elongated watertight seal which extends in a continuous loop around the skin's outer periphery and proximate therewith, the intact skin defining a watertight enclosure bounded by said elongated continuous watertight seal, the upper membrane defining at least one charging slot which is spaced apart from the elongated continuous watertight seal and connected to the enclosure;

(c) the upper membrane, which is triangularly shaped, having each of its heat welded joints with the lower membrane situated proximate with one of the upper membrane's three elongated sides, each of the upper membrane's first and second elongated sides, which are disposed perpendicularly with respect to each other and which are oriented generally at an acute angle to its third elongated side, being similar in length, the first elongated side being sufficiently long that when portions of the lower membrane are positioned, in use, contiguous with the interior corner's intersecting vertical faces, the first elongated side slopes noticeably downwardly from a location common to said vertical faces along the parapet's interior corner to a point in close proximity to the parapet-penetrating opening; and the second elongated side, likewise extending downwardly from approximately said location, reaches a point, along the parapet/roof joint and distal from said opening, which is spaced apart therefrom by the span of the third elongated side;

(d) a solidified spray foam filling, formed by feeding spray foam-generating chemical agents, in their respective liquid states, through the charging slot and into the enclosure, the spray foam filling being disposed inwardly of the elongated continuous watertight seal; and (e) wherein once the skin has been mounted on the building in such a way that said portions of the lower membrane are so positioned contiguous with the interior corner's intersecting vertical faces and once the enclosure has been filled to substantially its full capacity with solidified spray foam, the solidified filling has an overall shape which, if the solidified filling were cut straight through horizontally, would be generally triangular in transverse cross-section, with each transverse cross-section so cut being generally larger in size than any such transverse cross-section disposed upwardly of it, thus giving the skin, backed by the solidified filling, a facade, disposed inwardly of the interior corner, which slopes downwardly and generally away from both of the corner's intersecting faces, so that storm water which would otherwise fall onto the roof near the corner and/or flow across the roof towards it is instead intercepted by the facade and funneled along its base directly into the parapet-penetrating opening.

5. The barrier according to claim 4, which further comprises means for mechanically fastening first and second elongated sides of the upper membrane, proximate with its outer periphery and outwardly of the elongated continuous watertight seal, to the parapet, as well as means for so fastening the upper membrane's third elongated side to the roof deck.

6. The barrier according to claim 4, which further comprises a patch which is affixed to the upper membrane so as to cover the charging slot, the patch being affixed to permanently cover the charging slot after the spray foam-generating chemical agents have been fed through the charging slot and into the enclosure and the spray foam therein has solidified.

7. A barrier system adapted to be mounted on a building having a generally flat or low pitch roof with a parapet and proximate with a pair of spaced apart, parapet-penetrating openings, which comprises:

(a) at least one skin which includes upper and lower sheet-like membranes, each membrane being generally angular in shape and having been fabricated from a heat weldable, thermoplastic material, the upper and lower membranes being affixed to each other along a plurality of heat welded joints, each of said heat welded joints forming a watertight seal which is an integral part of an elongated watertight seal which extends in a continuous loop proximate with, and inwardly of, the skin's outer periphery, the skin, when intact, defining a watertight enclosure;

(b) the upper membrane defining at least one charging slot which is spaced apart from the elongated watertight seal and connected to the enclosure;

(c) a solidified spray foam filling, formed by feeding spray foam-generating chemical agents, in their respective liquid states, through the charging slot and into the enclosure, the spray foam filling being disposed inwardly of the elongated watertight seal;

(d) the upper membrane having first and second elongated side edges which, at their respective heat welded joints with the lower membrane, are generally oriented at an acute angle to a third elongated, heat welded joint between the upper and lower membranes; and (e) wherein the skin, when filled to substantially its full capacity with said solidified spray foam and stretched out in such a way that the third elongated, heat welded joint spans the distance between said pair of parapet-penetrating openings, has a raised profile with a generally triangularly shaped base which extends inwardly from the parapet, with the first and second side edges converging distally from the parapet along the base's exposed periphery; and (f) wherein whenever an adjoining pair of the triangularly shaped skins are so deployed and filled with the solidified foam, the first elongated side of one of said adjoining pair's skins is narrowly spaced apart from the second elongated side of the other skin in said adjoining pair, thus forming a funnel-like channel through which storm water captured on the roof can flow into the parapet-penetrating opening disposed between said adjoining pair.

* * * * *